US007306099B2

(12) United States Patent
Chen

(10) Patent No.: US 7,306,099 B2
(45) Date of Patent: Dec. 11, 2007

(54) TOOLBOX

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 645 days.

(21) Appl. No.: 10/930,670

(22) Filed: Aug. 31, 2004

(65) Prior Publication Data

US 2006/0042980 A1 Mar. 2, 2006

(51) Int. Cl.
*B65D 85/28* (2006.01)

(52) U.S. Cl. ..... 206/379; 206/373

(58) Field of Classification Search ..... 206/372, 206/373, 379, 380, 349, 234, 443, 806, 745, 206/754, 774; 220/255, 810, 826; D3/905
See application file for complete search history.

(56) References Cited

U.S. PATENT DOCUMENTS 2,138,916 A * 12/1938 Gaess ..... 206/265
2,584,721 A * 2/1952 Linneman ..... 220/812
2,670,842 A * 3/1954 Kruft ..... 206/372
3,904,035 A * 9/1975 Metzler et al. ..... 206/379
5,098,235 A * 3/1992 Svetlik et al. ..... 408/234
6,047,830 A * 4/2000 Chang ..... 206/576
D427,436 S * 7/2000 Chan ..... D3/292
6,415,923 B1 * 7/2002 Chen ..... 206/379
2002/0092786 A1 * 7/2002 Shu ..... 206/379
2005/0126944 A1 * 6/2005 Wang ..... 206/379

* cited by examiner

*Primary Examiner*—Mickey Yu
*Assistant Examiner*—J. Gregory Pickett
(74) *Attorney, Agent, or Firm*—Alan Kamrath; Kamrath & Associates P.A.

(57) ABSTRACT

A toolbox has a body, a top holder, a bottom holder, a first cap and a second cap. The top holder and the bottom holder are mounted in the body. The first cap and the second cap are pivotally attached to the body, engage each other to open and close together and cover the top holder, so that the toolbox opens easily. Further, the caps are made of a transparent material and allow the tools in the toolbox to be seen easily.

6 Claims, 3 Drawing Sheets

TOOLBOX

BACKGROUND OF THE INVENTION

1. Field of Invention

The present invention relates to a toolbox, and more particularly to a toolbox that is convenient to use and displays tools in the toolbox well.

2. Description of the Related Art

Toolboxes are used to store tools and come in many types. A common type toolbox has a container and a cap mounted on the container. Tool heads or tool bits are stored inside the container.

However some of the disadvantages of conventional toolboxes include the following.

1. Because the cap is not securely attached to the container, the cap easily falls off of and gets separated from the toolbox when tools in a conventional toolbox are being used.

2. Most conventional toolboxes do not have the capability to display tools inside toolboxes well.

The toolbox in accordance with the present invention obviates or mitigates the aforementioned problems.

SUMMARY OF THE INVENTION

The primary objective of the present invention provides a toolbox that has a body, a top holder, an optional bottom holder, a first cap and a second cap. The top holder and the optional bottom holder are mounted in the body. The first cap and the second cap are pivotally to the body and engage each other to open and close together and cover the top holder, so that the toolbox opens easily. Further, the caps are made of a transparent material and allow the tools in the toolbox to be seen easily.

Other objectives, advantages and novel features of the invention will become more apparent from the following detailed description when taken in conjunction with the accompanying drawings.

DETAILED DESCRIPTION OF THE INVENTION

Figure 1:
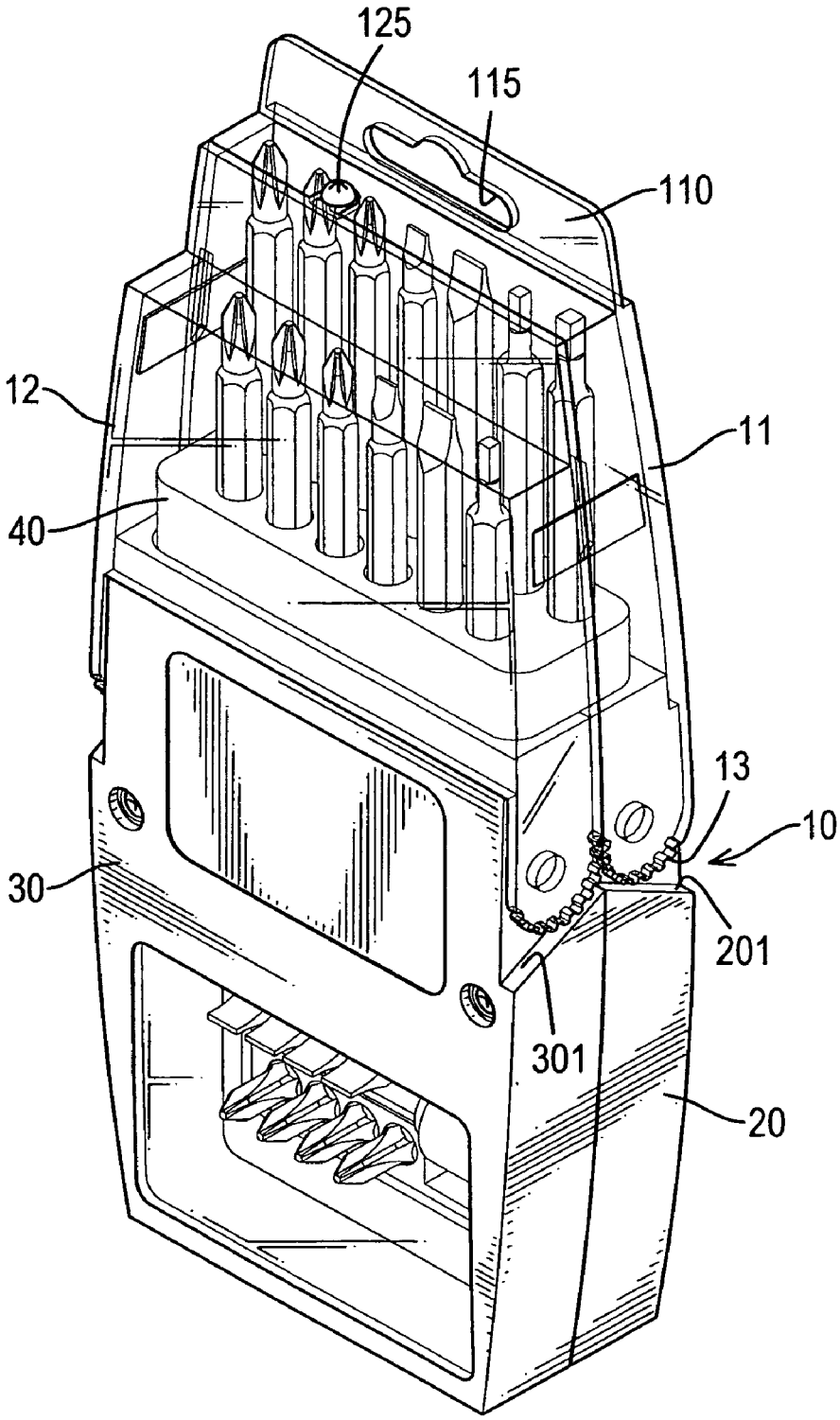
FIG. 1 is a perspective view of a toolbox in accordance with the present invention with the tool heads and bits stored inside.
Figure 2:
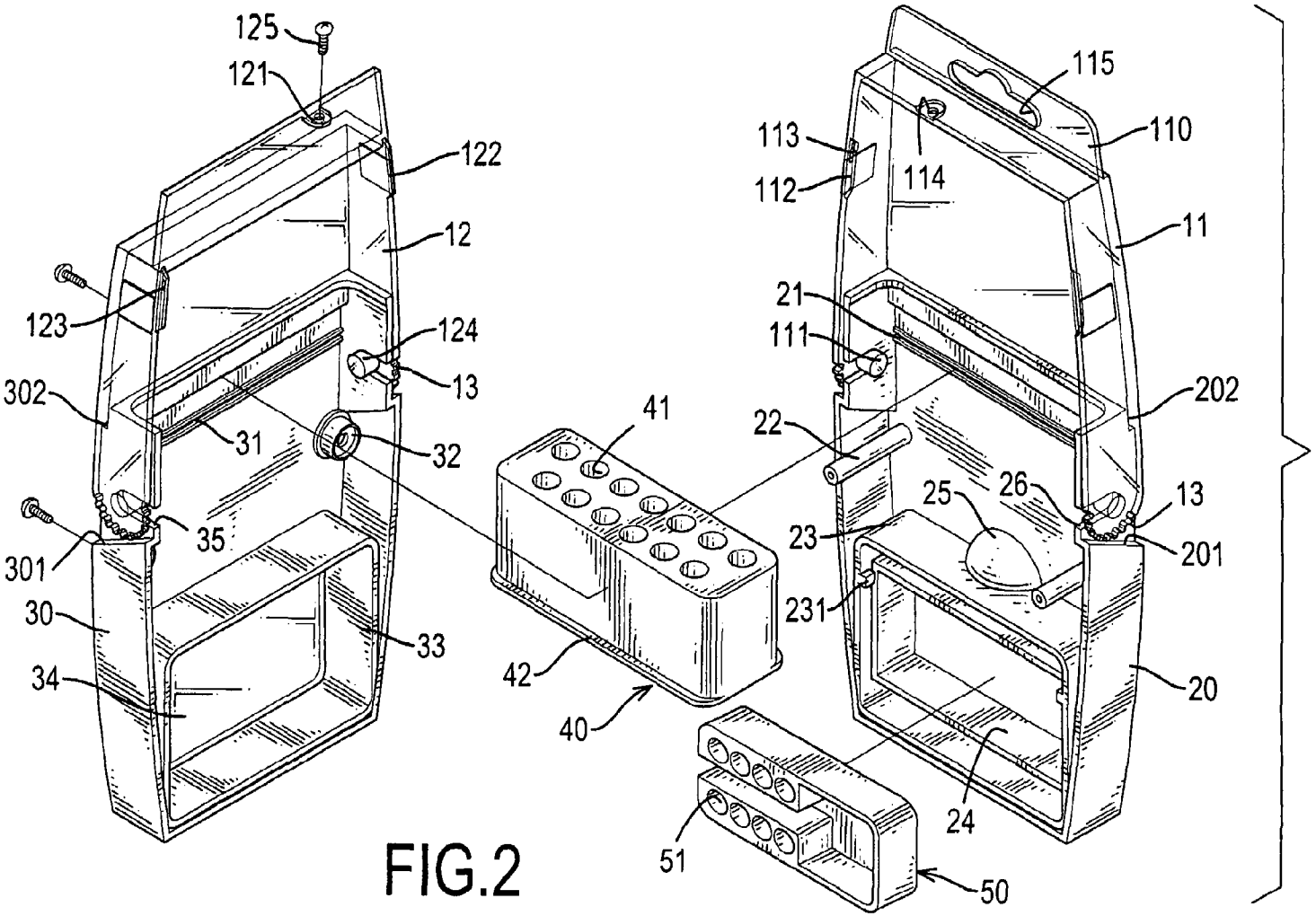
FIG. 2 is an exploded perspective view of the toolbox in FIG. 1.
Figure 3:
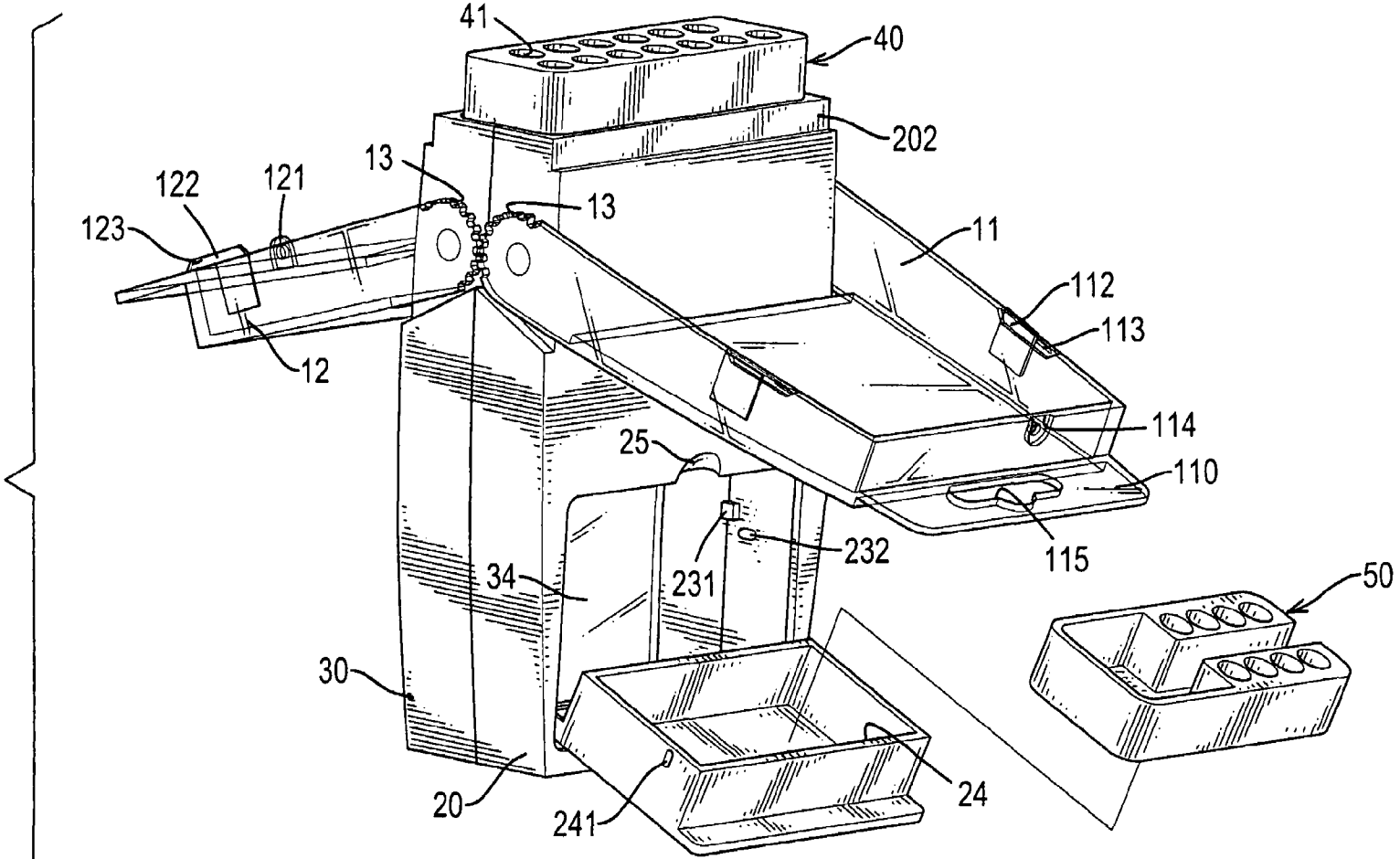
FIG. 3 is a partially exploded operational perspective view of the toolbox in FIG. 1.

With reference to FIGS. 1 to 3, a toolbox in accordance with the present invention has a body (10), a top holder (40), an optional bottom holder (50), a first cap (11), and a second cap (12). The top holder (40) and the optional bottom holder (50) are mounted in the body (10). The first cap (11) and the second cap (12) are pivotally attached to the body (10), engage each other to open and close together and cover the top holder (40).

The body (10) has a first cover (20) and a second cover (30). The first cover (20) is attached to the second cover (30).

The first cover (20) has a top edge, a bottom surface, two sidewalls, an inner surface, an outer surface, a cap recess (202), a mounting slot (21), two connector posts (22), an optional bottom holder housing (23), an optional seat (24) and an optional access recess (25). The sidewalls are integrally formed with the bottom surface. Each sidewall has an outer surface, a top edge, a recessed top segment, an inclined side (201) and a pivot slot (26). The recessed top segment is flush with the top edge and has an inclined bottom edge. The inclined sides (201) are defined respectively in the outer surfaces of the sidewalls at the inclined bottom edges of the recessed top segments. The pivot slots (26) are defined respectively in the recessed top segments of the sidewalls near the inclined sides (201). The cap recess (202) is defined in the outer surface of the first cover (20) at the top edge. The mounting slot (21) is formed transversely on the inner surface of the first cover (20) near the pivot slot (26). The connector posts (22) are formed on the inner surface of the first cover (20). The bottom holder housing (23) is defined in the inner surface of the first cover (20) near the bottom surface of the first cover (20) and has two inner sidewalls, two positive stops (231) and two protruding catches (232). The positive stops (231) are formed respectively on the inner sidewalls and align with each other. The protruding catches (232) are formed respectively on the inner sidewalls. The seat (24) is mounted pivotally inside the bottom holder housing (23) and has two outer sidewalls and two detents (241). The detents (241) are defined respectively in the outer sidewalls. When the seat (24) is pivoted into the bottom holder housing (23), the seat (24) abuts the positive stops (231) and is held in place by the protruding catches (232) engaging the detents (241). The optional access recess (25) is defined in the outer surface of the first cover (20) to make opening the seat (24) easier.

The second cover (30) has a top edge, a bottom surface, two sidewalls, an inner surface, an outer surface, a cap recess (302), a mounting slot (31), two connector holes (32), an optional bottom holder housing (33) and an optional transparent window (34). The sidewalls are integrally formed with the bottom surface. Each sidewall has an outer surface, a top edge, a recessed top segment, an inclined side (301) and a pivot slot (35). The recessed top segment is flush with the top edge and has an inclined bottom edge. The inclined sides (301) are defined respectively in the outer surfaces of the sidewalls at the inclined bottom edges of the recessed top segments. The pivot slots (35) are defined respectively in the recessed top segments of the sidewalls near the inclined sides (301). The cap g recess (302) is defined in the outer surface of the second cover (30) at the top edge. The mounting slot (31) is formed transversely on the inner surface of the second cover (30) near the pivot slot (35). The connector holes (32) are defined through the outer and inner surfaces of the second cover (30) and aligned respectively with the connector posts (22) on the first cover (20). The bottom holder housing (33) is formed on the inner surface of the second cover (30) near the bottom surface of the second cover (30). The optional transparent window (34) is mounted on the bottom holder housing (33) and is flush with the outer surface of the second cover (20).

The top holder (40) is mounted between the first cover (20) and the second cover (30), extends from the body (10) and has a top surface, two longitudinal bottom edges, multiple blind holes (41) and two flanges (42). The blind holes (41) are defined in the top surface of the top holder (40) and hold tool bits. The flanges (42) are formed respectively on the longitudinal bottom edges and are mounted respectively in the mounting slots (21,31) in the first cover (20) and second cover (30).

The bottom holder (50) is mounted inside the seat (24) and has a top surface and multiple blind holes (51). The blind holes (51) are defined in the top surface of the bottom holder (50) and hold tool bits.

The first cap (11) is pivotally attached to the first cover (20) and has a top, a hanging tab (110), two sidewalls, an outside wall, an internal cavity, two pivot pins (111), two latch recesses (112), two optional latch detents (113), an optional tongue recess (114) and two gear segments (13). The top has an outside surface, an inside surface, two ends, an inside edge and an outside edge. The hanging tab (110) is integrally formed on and extends from the outside surface of the top at the outside edge and has a through hole (115) defined through the hanging tab (110). The sidewalls are integrally formed respectively with the ends of the top and extend down from the inside surface. Each sidewall has a bottom edge, an outside edge, an inside edge and an inside surface. The outside wall is formed integrally with the outside edges of the sidewalls and the top to form the internal cavity. The pivot pins (111) are formed respectively on the inside surfaces of the sidewalls near the bottom edges, face each other and are pivotally mounted respectively in the pivot slots (26). The two latch recesses (112) are defined respectively in the inside edges of the sidewalls. The latch detents (113) are defined respectively in the latch recesses (112). The tongue recess (114) is formed in the outside surface of the top at the inside edge and has a through hole defined in the tongue recess (114). The two gear segments (13) are defined respectively on the bottom edges of the sidewalls.

The second cap (12) faces the first cap (11), is pivotally attached to the second cover (30) and has a top, an inside wall, two sidewalls, an outside wall, an internal cavity (give it a number), two pivot pins (124), two latches (122), two optional latch ribs (123), an optional tongue (121), an optional screw (125) and two gear segments (13). The top has an outside surface, an inside surface, two ends, an inside edge and an outside edge. The inside wall is formed on and extends from the outside surface of the top at the inside edge. The sidewalls are integrally formed respectively with the ends of the top and extend down from the inside surface. Each sidewall has a bottom edge, an outside edge, an inside edge and an inside surface. The outside wall is formed integrally with the outside edges of the sidewalls and the top to form the internal cavity. The pivot pins (124) are formed respectively on the inside surfaces of the sidewalls near the bottom edges, face each other and are pivotally mounted respectively in pivot slots (35). The latches (122) extend out respectively from the inside edges of the sidewalls and correspond respectively to the latch recesses (112). The latch ribs (123) are formed respectively on the latches (122) and held in the latch detents (113) when the first and second caps (11, 12) are closed. The tongue (121) has a through hole defined in the tongue (121) and corresponding to and aligning with the through hole in the tongue recess (114) so the screw (125) can securely hold the first and second cap (11, 12) together. The two gear segments (13) are defined respectively on the bottom edges of the sidewalls and mesh respectively with the gear segments (13) on the first cap (11).

When the toolbox in accordance with the present invention is used, the first cap (11) and the second cap (12) abut each other and the gear segment on the first cap (11) and the second cap (12) mesh with each other. The first cover (20) is attached to the second cover (30) be multiple screws passing respectively through the connector holes (32) and into the connector posts (22). When a user wants to open the toolbox, rotating the first cap (11) or the second cap (12) around the pivot pins (111, 124) makes the gear segments (13) to push the first cap (11) and the second cap (12) open. The gear segments (13) stop rotating when the sidewalls of the first cap (11) and the second cap (12) respectively abut the inclined side (201, 301) of the first cover (20) and the second cover (30). When the toolbox is closed, the first cap (11) and the second cap (12) will be stopped by the cap recesses (202, 302) in the first cover (20) and the second cover (30).

In a preferred embodiment, the first cap (11) and the second cap (12) are transparent, so that the tool bits inside the toolbox can be displayed well. In a preferred embodiment, the screw (125) extends through the optional tongue (121) on the second cap (12) and screws into the tongue recess (114) in the first cap (11) to guard against theft or shoplifting of the tool bits.

The bottom holder (50) holds different tool bits. When a user wants to remove a tool bit from the optional bottom holder (50), the user only pivots the seat (24) to expose the tool bits. Also, because of the transparent window (34) of the second cover (30), the tool bits inside the bottom holder (50) can be displayed well.

The toolbox in accordance with the present invention has the following advantages.

1. The toolbox opens and closes conveniently. A person only has to pull or push one of the caps (11, 12) to open or close the toolbox.

2. The toolbox displays stored tools well. The caps (11, 12) and the transparent window (34) are made of a transparent material so tool bits stored in the toolbox are clearly visible.

3. The toolbox provides a multiple ways to hold and display tool bits. Because the bottom holder (50) is mounted inside the seat (24), the toolbox can provide a different way to show and hold tool bits.

The invention may be varied in many ways by a person skilled in the art. Such variations are not to be regarded as a departure from the spirit and scope of the invention, and all such modifications are intended to be included within the scope of the following claims.

What is claimed is:

1. A toolbox comprising a body having a first cover having a top edge, a bottom surface, two sidewalls integrally formed with the bottom surface and each sidewall having an outer surface, a top edge, a recessed top segment flush with the top edge and having an inclined bottom edge, an inclined side defined in the outer surface of the sidewall at the inclined bottom edge of the recessed top segment, and a pivot slot defined in the recessed top segment of the sidewall near the inclined side, an inner surface, an outer surface, a cap recess defined in the outer surface of the first cover at the top edge, a mounting slot formed transversely on the inner surface of the first cover near the pivot slot, and two connector posts formed on the inner surface of the first cover, and a second cover attached to the first cover having a top edge, a bottom surface, two sidewalls integrally formed with the bottom surface, each sidewall having
an outer surface,
a top edge,
a recessed top segment flush with the top edge and has an inclined bottom edge,
an inclined side defined in the outer surface of the sidewall at the inclined bottom edge of the recessed top segment, and
a pivot slot defined in the recessed top segment of the sidewall near the inclined side,
an inner surface,
an outer surface,
a cap recess defined in the outer surface of the second cover at the top edge,
a mounting slot formed transversely on the inner surface of the second cover near the pivot slot, and
two connector holes defined through the outer and inner surfaces of the second cover and aligned with the connector posts on the first cover, a top holder mounted between the first cover and the second cover, extending from the body and having
a top surface,
two longitudinal bottom edges,
multiple blind holes defined in the top surface of the top holder to hold tool bits, and
two flanges formed respectively on the longitudinal bottom edges and mounted respectively in the mounting slots in the first cover and second cover, a first cap pivotally attached to the first cover, having
a top having
an outside surface,
an inside surface,
two ends,
an inside edge, and
an outside edge,
a hanging tab integrally formed on and extending from the outside surface of the top at the outside edge and having a through hole defined through the hanging tab,
two sidewalls integrally formed respectively with the ends of the top and extended down from the inside surface to form an internal cavity, each sidewall having
a bottom edge,
an outside edge,
an inside edge, and
an inside surface,
two pivot pins formed respectively on the inside surfaces of the sidewalls near the bottom edges, facing each other and pivotally mounted respectively in the pivot slots of the first cover,
two latch recesses defined respectively in the inside edges of the sidewalls, and
two gear segments defined respectively on the bottom edges of the sidewalls, and a second cap pivotally attached to the second cover and engaged with the first cap, having
a top having
an outside surface,
an inside surface,
two ends,
an inside edge, and
an outside edge,
an inside wall formed on and extending from the outside surface of the top at the inside edge,
two sidewalls integrally formed respectively with the ends of the top and extending down from the inside surface, each sidewall having
a bottom edge,
an outside edge,
an inside edge, and
an inside surface,
an outside wall formed integrally with the outside edges of the sidewalls and the top to form an internal cavity,
two pivot pins formed respectively on the sidewalls near the bottom edges, facing each other and pivotally mounted respectively in the pivot slots of the second cover,
two latches extending out respectively from the inside edges of the sidewalls and corresponding respectively to the latch recesses, and
two gear segments defined respectively on the bottom edges of the sidewalls and mesh with the gear segments on the first cap.

2. The toolbox as claimed in claim 1, wherein the first cover further comprises
a bottom holder housing defined in the inner surface of the first cover and having
two inner sidewalls, and
two protruding catches formed respectively on the inner sidewalls,
a seat mounted pivotally inside the bottom holder housing and having
two outer sidewalls, and
two detents defined respectively in the outer sidewalls, and
an access recess defined in the outer surface of the first cover, and
the toolbox further comprises a bottom holder mounted inside the seat in the first cover, the bottom holder having
a top surface, and
multiple blind holes defined in the top surface.

3. The toolbox as claimed in claim 2, wherein the bottom holder housing further comprises two positive stops formed respectively on and protrude respectively from the inner sidewalls.

4. The toolbox as claimed in claim 1, wherein the first cap further comprises a tongue recess defined in the outside surface of the top and having a through hole defined in the tongue recess, and
the second cap further comprises
a tongue formed on the top edge and received in the tongue recess, having a through hole defined in the tongue, and
a bolt mounted through the through hole in the tongue of the second cap and the tongue recess of the first cap.

5. The toolbox as claimed in claim 1, wherein the second cover further comprises
a bottom holder housing formed on the inner surface of the second cover besides the bottom surface of the second holder, and
a transparent window mounted on the bottom holder housing.

6. The toolbox as claimed in claim 1, wherein the first cap and the second cap are made of a transparent material.

* * * * *